US007833582B2

(12) United States Patent
Brehm et al.

(10) Patent No.: US 7,833,582 B2
(45) Date of Patent: Nov. 16, 2010

(54) METHOD FOR PRODUCING A METALLIC COATING IN CERTAIN AREAS OF A SUBSTRATE, TRANSFER FILM, AND USE THEREOF

(75) Inventors: Ludwig Brehm, Adelsdorf (DE); Heinrich Wild, Herzogenaurach (DE)

(73) Assignee: Leonhard Kurz Stiftung & Co. KG, Furth (DE)

( * ) Notice: Subject to any disclaimer, the term of this patent is extended or adjusted under 35 U.S.C. 154(b) by 959 days.

(21) Appl. No.: 11/571,374

(22) PCT Filed: Jun. 23, 2005

(86) PCT No.: PCT/DE2005/001136

§ 371 (c)(1),
(2), (4) Date: Dec. 28, 2006

(87) PCT Pub. No.: WO2006/000201

PCT Pub. Date: Jan. 5, 2006

(65) Prior Publication Data

US 2008/0095956 A1 Apr. 24, 2008

(30) Foreign Application Priority Data

Jun. 28, 2004 (DE) ..... 10 2004 031 099

(51) Int. Cl.
*B05D 1/36* (2006.01)
*B05D 3/10* (2006.01)

(52) U.S. Cl. ..... 427/258; 427/270; 427/271; 427/333; 427/250; 427/340; 204/192.1; 204/192.14

(58) Field of Classification Search ..... 427/258, 427/270, 271, 333, 250–253, 261, 340–341; 204/192.1, 192.14
See application file for complete search history.

(56) References Cited

U.S. PATENT DOCUMENTS

| | | | | |
|---|---|---|---|---|
| 4,232,077 | A * | 11/1980 | Meisel | 428/174 |
| 4,239,548 | A * | 12/1980 | Barnard et al. | 106/439 |
| 4,242,378 | A | 12/1980 | Arai | |
| 4,687,680 | A | 8/1987 | Narui et al. | |
| 4,759,969 | A * | 7/1988 | Sander | 428/209 |
| 5,270,078 | A * | 12/1993 | Walker et al. | 427/264 |
| 5,731,064 | A | 3/1998 | Suss | |
| 6,248,198 | B1 * | 6/2001 | Yen | 156/209 |

FOREIGN PATENT DOCUMENTS

| | | |
|---|---|---|
| DE | 1419376 | 10/1968 |
| DE | 1298710 | 7/1969 |
| DE | 3430111 | 10/1985 |
| DE | 10256491 A1 | 9/2003 |
| EP | 0239197 | 9/1987 |
| RU | 2142882 C1 | 12/1999 |
| WO | WO9850241 | 11/1998 |

OTHER PUBLICATIONS

Decision on Grant, Patent for Invention.

* cited by examiner

*Primary Examiner*—Frederick J Parker
*Assistant Examiner*—Alex Rolland
(74) *Attorney, Agent, or Firm*—Hoffmann & Baron, LLP

(57) ABSTRACT

The invention concerns a process for the production of a region-wise metallization on a carrier substrate, wherein the carrier substrate is at least region-wise provided with a soluble colored first layer which on its side remote from the carrier substrate is provided over its full area with a metal layer, as well as a transfer film with a region-wise metalization and the use thereof.

30 Claims, 3 Drawing Sheets

METHOD FOR PRODUCING A METALLIC COATING IN CERTAIN AREAS OF A SUBSTRATE, TRANSFER FILM, AND USE THEREOF

This application claims priority based on an International Application filed under the Patent Cooperation Treaty, to Application No. PCT/DE2005/001136, filed on Jun. 23, 2005 and German Application No. 102004031099.8-45, filed on Jun. 18, 2004, which are both incorporated herein by reference.

BACKGROUND OF THE INVENTION

The invention concerns a process for the production of a region-wise metallization on a carrier substrate, wherein the carrier substrate is at least region-wise provided with a soluble colored first layer which on its side remote from the carrier substrate is provided over its full area with a metal layer. The invention further concerns a transfer film which includes a carrier substrate and a transfer layer arrangement with a region-wise metallization, wherein the carrier substrate is in the form of a carrier film and the transfer layer arrangement has at least one colored first layer arranged region-wise and a metal layer arranged in coincident relationship with the first layer, as well as the use thereof.

A process of that kind and a transfer film of that kind are known from WO 98/50241. Disclosed therein is a composite film structure which in region-wise manner has a reflecting metal layer which is formed in coincident relationship or in accurate register relationship on regions of a lacquer layer. In that case a carrier film is coated with a soluble, possibly colored first lacquer layer and the side of the first lacquer layer which is remote from the carrier film is covered with a reflecting metal layer. Now, regions of the metal layer are to be removed, by a procedure whereby either a base is applied in a desired pattern to the metal layer or a layer which is insoluble in a base is applied in a pattern to the metal layer and then a base is applied to the insoluble layer and the regions of the metal layer, which have remained free. The base is now said to dissolve the soluble first lacquer layer through the metal layer. It has proven to be extremely difficult however to dissolve the first lacquer layer reliably and completely in the desired regions in that way. The reason for that appears to be due to the applied metal layer which is usually formed by way of a PVD process (physical vapor deposition), generally by means of vapor deposition or cathode sputtering on the first lacquer layer. At least in the region of the surface of the first lacquer layer which is in contact with the metal layer formed, that results in a change in the chemical structure of the first lacquer layer, which has the consequence that the previously base-soluble first lacquer layer becomes insoluble for the base at least in region-wise manner and thus prevents or gives rise to difficulty in structuring of the metal layer.

It is known from DE 102 56 491 A1 for a metal layer to be partially coated with an etch resist lacquer and for the exposed regions of the metal layer to be removed by etching in order to produce a region-wise metallization. It is further disclosed for a soluble lacquer layer to be applied region-wise to a carrier substrate, for a metal layer to be arranged over the lacquer layer and the regions of the carrier substrate which are free thereof, and for the lacquer layer then to be dissolved in order to produce a region-wise metallization on the carrier substrate.

In addition described there is a process in which a soluble lacquer is printed upon region-wise with a hardening agent, the hardening agent and regions of the lacquer which are free thereof are coated with a metal layer and then the lacquer is dissolved in the regions in which there was no hardening agent, including the metal layer disposed thereon, thereby to produce a region-wise metallization of the carrier substrate in accurate register relationship with the hardened regions of the lacquer. As already described hereinbefore those two processes as last described, when using a large number of lacquers, have the consequence that the solubility of the lacquer layer is markedly worsened after the metallization operation so that definedly dissolving away the lacquer layer regions which were provided directly with the metal layer is made difficult or even impossible.

It is further described that a soluble first color or lacquer layer is applied to a carrier substrate over the full area and partially covered with a second color or lacquer layer containing a hardener for the first layer. The regions of the first layer in which the second layer was not present are dissolved by a solvent so that regions with two color layers in accurate register relationship are formed.

DE 34 30 111 C1 discloses a film having a decorative metal layer and a process for the production thereof. In that case, a soluble lacquer on a carrier film is printed upon in region-wise manner with a hardening agent or a hardening lacquer containing a hardener in excess. The hardener diffuses into the subjacent soluble lacquer and hardens it. In that case a concentration gradient of the hardener is produced in the soluble lacquer, wherein the level of hardener concentration decreases in the direction of the carrier film and hardening of the soluble layer to locally different degrees is implemented thereby. In that way, unhardened regions of the soluble lacquer can be present in the region of the carrier film and are also entirely or partially also dissolved away when washing off the regions which were not printed upon with hardening agent. However even if hardening of the soluble lacquer in the region of the carrier film is sufficient to provide that solubility is no longer involved, the irregular hardening of the soluble lacquer, which occurs by virtue of the concentration gradient, has a detrimental effect on its mechanical properties. Furthermore a residue of the pure hardening agent (or however the hardening lacquer) always remains behind at the surface of the previously soluble lacquer and is thus between the metal layer and the previously soluble lacquer. That can result in inadequate adhesion of the metallization.

SUMMARY OF THE INVENTION

Now the object of the invention is to provide an improved process for forming a region-wise metallization in accurate register relationship on a carrier substrate as well as a transfer film with sharply delimited metallization regions in accurate register relationship.

In regard to the process in which the carrier substrate is at least region-wise provided with a soluble colored first layer which on its side remote from the carrier substrate is provided over its full area with a metal layer, the object is attained in that either a) at least one soluble second layer is partially arranged between the first layer and the metal layer, or b) at least one insoluble third layer is arranged region-wise on the side of the first layer which is towards the metal layer and a soluble second layer is applied at least partially to the side of the third layer which is towards the metal layer and partially to the regions of the first layer which are free of the third layer, wherein in cases a) and b)

a hardener is added to the first layer and an additive is added to the second layer, which additive is suitable for inactivating the hardener of the first layer, wherein the at least one third layer which is optionally provided is impenetrable to the additive, the additive of the second layer inactivates the hardener of the first layer in the regions of the first layer which are arranged in direct contact with the second layer before the first layer is hardened by the hardener, and the second layer and the regions of the first layer in which the hardener was inactivated are dissolved and removed by means of a liquid, wherein the metal layer is removed in the regions which were arranged directly on the second layer.

In accordance with the invention therefore the regions of the first layer which are to be dissolved again are at no point coated directly with the metal layer so that there is no change in the solubility of the first layer due to the coating with the metal layer. In accordance with the invention the regions of the first layer which are to be dissolved again are brought into direct contact with the second layer which has an additive which is matched to a hardener contained in the first layer. The additive in the second layer inactivates the hardener in the first layer before the hardener becomes active and hardens the first layer. The second layer and regions of the first layer which are left free thereof are coated with a metal layer which is preferably formed in a PVD process such as vapor deposition or cathode sputtering. After only region-wise hardening of the first layer in the regions of the first layer which were not coated with the second layer and in which therefore inactivation of the hardener in the first layer did not occur, the second layer and the regions of the first layer in which the hardener was inactivated are dissolved and removed by means of the liquid. In that case the part of the metal layer which is arranged directly on the second layer is also removed and thus region-wise metallization is formed on the carrier substrate. The region-wise metallization is to be found at the locations at which the first layer was coated directly with the metal layer and hardened. The at least one third layer which is present in case b) is insoluble and permits additional decorative effects. In that respect the optical impressions of the first and third layers can be mutually superimposed and the third layer can also be provided at least region-wise with the metal layer. The process according to the invention permits the unhardened regions of the first layer and the regions of the metal layer which are arranged thereon to be reliably dissolved away, in which case metal layer regions of defined dimensions and with sharp edges can be reproducibly produced. On the one hand the first lacquer layer is divided into hardened and unhardened regions and on the other hand the regions of the first lacquer layer which are to be hardened are also coated directly with the metal layer, which leads to the above-described reduction in the solubility of the first lacquer layer. That dual influence on the first lacquer layer is to be viewed as the cause of the high level of edge sharpness of the metallization regions formed and for the extremely high degree of register accuracy in respect of the hardened regions of the first lacquer layer and the regions arranged thereon of the metal layer.

It is particularly advantageous in that respect in comparison with DE 34 30 111 C1 that the hardened regions of the first layer which remain in accordance with the invention under the regions of the first layer, by virtue of their production history, have a uniform degree of hardening over their area and also—as viewed in cross-section—over their layer thickness, as the hardener is already distributed uniformly in the material for forming the first layer in the operation of forming the first layer. Uniform hardening of the first layer can be established for example by abrasion, solubility, the refractive index, the molar mass or a molecular weight of the first layer—as viewed in cross-section—being ascertained for different layer depths, and compared together. In addition it is possible for the degree of hardening of the first layer to be ascertained for example by way of the vapor pressure of polymers in the first layer or by ascertaining the deformability of the first layer—also viewed in cross-section—for different layer depths, and compared together. With the process according to the invention different measurement values are not to be found in the resulting hardened first layer.

It has proven to be particularly worthwhile for the process if a hardener in the first layer is selected on an aziridin basis or on a polyimine basis and the second layer is formed from a water-soluble, strongly alkaline printing ink with a pH-value in the range of 11 to 14.

In particular it has been found desirable in that respect if the printing ink is produced in alkaline form by means of sodium hydroxide or potassium hydroxide, the sodium hydroxide or the potassium hydroxide forming the additive. It has been found that those additives from the second layer reliably inactivate an aziridin-based or polyimine-based hardener in the first layer and thus reproducibly region-wise prevent hardening of the first layer. Hardeners of that kind acceleratedly harden the first layer only at temperatures above about 80° C. At ambient temperature hardening takes place only very slowly so that inactivation of the hardener by the additive in the printing ink can be effected in particular when it is applied "inline" to the first layer in a subsequent printing mechanism.

The printing ink for forming the second layer is in that case preferably mixed with a coloring filler or pigment in order to be able to subject the arrangement and provision of the second layer formed to a visual check in a simple fashion. In that respect it has proven desirable for barium sulfate, titanium oxide or zinc sulfide to be added to the printing ink in order to make it clearly visible.

The object of the invention is attained for the transfer film, in particular a hot stamping film, in that the first layer is hardened by means of an aziridin-based or polyimine-based hardener, wherein the first layer as considered over the layer thickness thereof is uniformly hardened.

That results in optimum mechanical properties of the first layer combined with good adhesion of the metal layer to the hardened first layer.

Sharply delimited regions of the first layer can be produced by virtue of the locally sharply defined influencing action of a base on such a hardener in the direct contact region and thus there are also sharply delimited metallization regions in accurate register relationship.

The first layer is preferably formed by an alkali-soluble lacquer, preferably based on polyacrylic acid or styrene maleic acid anhydride.

Preferably a layer thickness in the range of between 0.7 and 2 μm is selected for the first layer. In that range the additive of the second layer can reliably inactivate the hardener in the first layer over the entire layer thickness of the first layer. It has proven desirable for the second layer to be formed with a thickness in the range of between 0.8 and 3 μm.

It has proven desirable if the first layer is transparent in order to make the metal mirror visible through the first layer and to show it off to full advantage. In that respect the first layer can be composed of a plurality of transparent layers, the optical effects of which influence each other.

It has proven desirable if the carrier film and/or the transfer layer arrangement of the transfer film are at least partially transparent. By way of example transfer layer arrangements which are transparent in region-wise manner and which are applied to a value-bearing document make it possible for the surface of the document still to be recognized and to achieve an additional level of safeguard against forgery.

It has proven desirable if the transfer layer arrangement has an adhesive layer, wherein the adhesive layer is arranged at the side of the transfer layer arrangement which is remote from the carrier film. When using a transparent adhesive for the adhesive layer for applying the transfer layer arrangement to a transparent substrate colored layers and metal layers of the transfer layer arrangement remain perceptible through the substrate and the adhesive layer.

With the at least one third layer which can be provided in the transfer layer arrangement, it is possible to achieve particular decorative effects if it is of a colored opaque nature and/or a colored transparent nature.

In order to facilitate transfer of the transfer layer arrangement of the transfer film onto for example a value-bearing document, it has proven to be advantageous if a wax-like separation layer is disposed between the carrier film and the transfer layer arrangement. Separation layers of that kind are usually of a thickness in the range of between 0.001 and 0.1 μm. The carrier film which is formed preferably from plastic materials such as for example PI, PP, PE, PET, PPS, LCP, PEN, PA, PVC, paper, fabrics or metal film is thereby easily released from the transfer layer arrangement under pressure and temperature in the hot stamping operation and permits accurate and complete application to a material to be stamped upon.

It is particularly preferable for the carrier substrate used to be a flexible film material of a thickness in the range of between 5 and 700 μm, preferably in the range of between 12 and 50 μm so that it can be prepared on a supply roll and endlessly processed.

It is particularly advantageous in that respect if the carrier substrate is transported from roll to roll to produce the region-wise metallization. That means that the carrier substrate can be withdrawn from a first supply roll, subjected to the process according to the invention, and possibly also further process steps, and finally wound onto a second supply roll which is subjected to further processing. By way of example stamping operations, temperature treatments or also an irradiation operation can be considered as the further process steps.

It is further particularly preferred if the metal layer is of a reflecting, preferably mirror-reflecting nature. That further enhances the decorative effect of the region-wise metallization.

It has proven desirable if the metal layer is formed from one of the metals aluminum, chromium, copper, nickel, iron, titanium, silver, gold or an alloy of two or more of those metals. Those metals can produce a mirror-reflecting metal layer.

The metal layer is preferably formed by vapor deposition or cathode sputtering so that these processes can be effected in a continuous and thus particularly economical procedure.

It is preferable for the metal layer or layers to be formed in a thickness in the range of between 10 and 100 nm.

The use of the transfer film according to the invention for forming security elements on data carriers, in particular value-bearing documents such as identity cards or passes, cards or bank notes, structural elements or decorative elements, in particular in architecture or other technical areas, packaging materials, in particular in the pharmaceutical or foodstuffs industry or component parts in the electrical engineering or electronic industry is ideal.

BRIEF DESCRIPTION OF THE DRAWINGS

FIGS. 1*a* through 3 are intended to describe the process according to the invention and the structure of a transfer film according to the invention by way of example. In the drawing:

FIG. 1*a* shows a view in cross-section of a carrier substrate with a first layer, a second layer and a metal layer, FIG. 3 shows a view in cross-section through a transfer film in the form of a hot stamping film with region-wise metallization.

DETAILED DESCRIPTION OF THE INVENTION

Figure 1A:
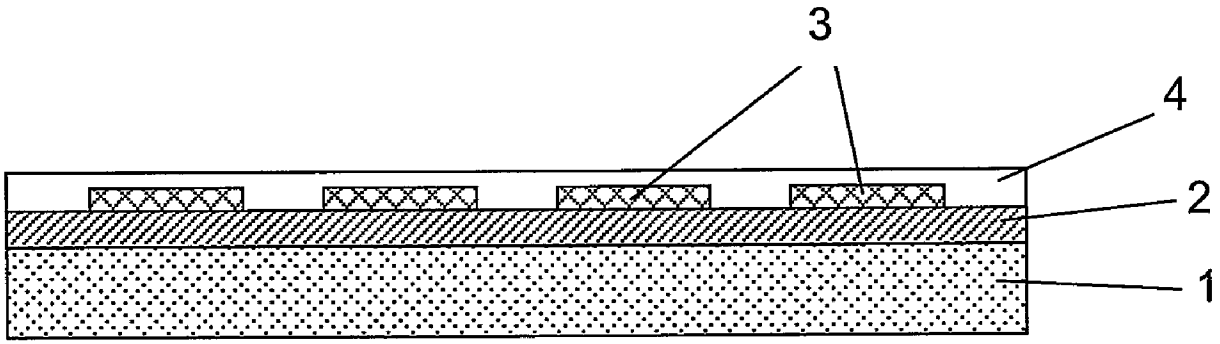

FIG. 1*a* is a view in cross-section of a carrier substrate 1 which is in the form of a carrier film and which is coated with an alkali-soluble colored lacquer based on styrene maleic acid anhydride (SMA) as the first layer 2.

The lacquer for forming the first layer was of the following composition:

| | |
|---|---|
| ethanol | 3200 g |
| ethylacetate | 3100 g |
| n-butanol | 100 g |
| SMA resin (mw about 200000, acid No about 250) | 1000 g |
| alcohol-soluble cellulose nitrate (norm 30 A) | 100 g |
| complex dyestuff orange | 85 g |
| complex dyestuff yellow | 38 g |
| aziridin hardener | 25 g |

In that case the carrier substrate 1 of PET is of a thickness of 25 μm and the first layer 2 is of a thickness of 1 μm. In that case the first layer 2 can be applied to the carrier substrate 1 over the full surface area or only partially. In the present case the first layer 2 contains an aziridin-based hardener. It is possible to provide between the carrier substrate 1 and the first layer 2, further lacquer layers, reflecting layers or other layers which for example can have magnetic properties. A water-soluble, strongly alkaline printing ink is partially applied to the first layer 2 as the second layer 3, the second layer containing sodium hydroxide as an additive and being 1.5 μm in thickness. Titanium oxide is added to the printing ink in order to obtain a well visible and controllable printing result.

The printing ink for forming the second layer was of the following composition:

| | |
|---|---|
| water | 9200 g |
| methylcellulose (low-molecular) | 750 g |
| silica highly dispersed | 150 g |
| titanium dioxide (rutile type) | 2000 g |
| ethanol | 1000 g |
| n-butanol | 600 g |
| soda lye (50 percent) | 2000 g |

A mirror-reflecting metal layer 4 of aluminum which is of a thickness of 40 nm covers the second layer 3 and the regions which are uncovered thereby of the first layer 2. The sodium hydroxide of the second layer 3 inactivates the hardener in the first layer 2 in the regions in which direct contact was produced between the first layer 2 and the second layer 3.

Figure 1B:
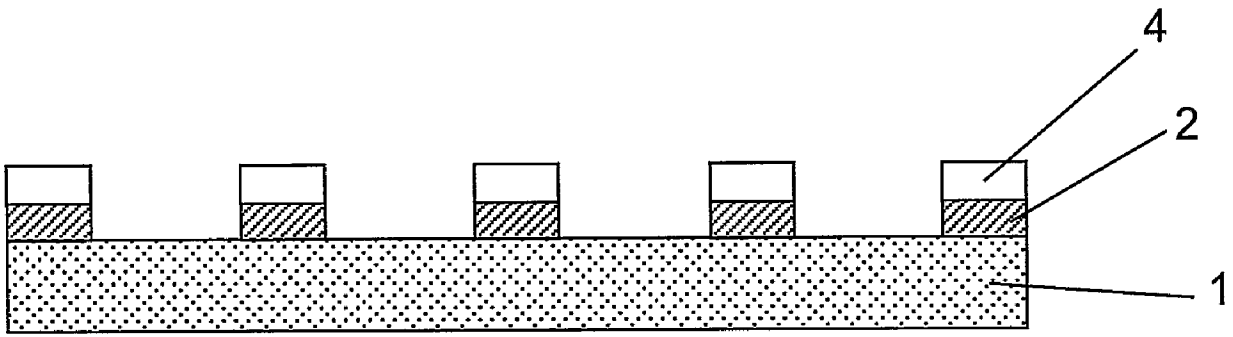
FIG. 1*b* shows the carrier substrate of FIG. 1*a* after dissolution of the second layer and unhardened regions of the first layer.

FIG. 1*b* shows the carrier substrate 1 of FIG. 1*a* after dissolution of the second layer 3 and non-hardened regions of the first layer 2 in water. It is only in the regions of the first layer 2, which were not covered by the second layer 3, that the hardener became active and resulted in hardening of the first layer 2. Accordingly those regions remain on the carrier substrate 1 including the regions of the metal layer 4, which are disposed directly thereon and which are in accurate register relationship, while the unhardened regions of the first layer 2 and the regions of the metal layer 4 which were arranged on the second layer 3 were removed.

Figure 2A:
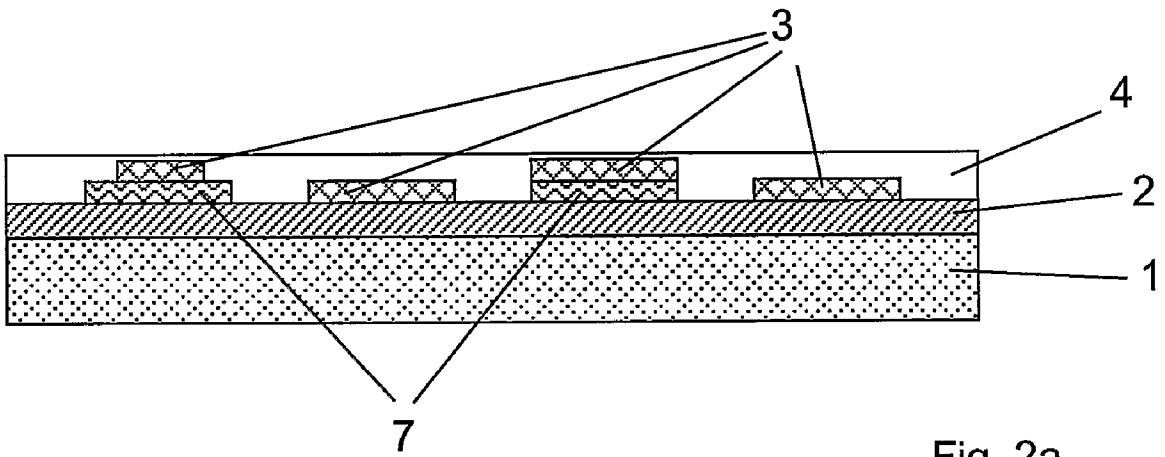
FIG. 2*a* shows a view in cross-section of a further carrier substrate with a first layer, a second layer, a third layer and a metal layer.

FIG. 2*a* shows a further carrier substrate 1 with a water-soluble styrene maleic acid anhydride-based first layer 2 as shown in FIG. 1*a*, which is applied to the full surface area thereof and which includes an aziridin-based hardener. The first layer 2 is colored and transparent. A water-insoluble, colored-transparent third layer 7 is applied partially to the first layer 2.

The water-insoluble lacquer for forming the third layer was of the following composition:

| | |
|---|---|
| methyl ethyl ketone | 2600 g |
| PMMA (high-molecular, Tg 120° C.) | 500 g |
| toluene | 2000 g |
| ester-soluble cellulose nitrate (norm 34 E) | 1000 g |
| cyclohexanone | 300 g |
| complex dyestuff red | 45 g |

In that respect a water-soluble second layer 3 which is formed from a strongly alkaline printing ink as shown in FIG. 1*a* is arranged partially on the third layer 7 and partially on the regions of the first layer 2 which are uncovered by the third layer 7. As an additive the second layer 3 contains sodium hydroxide which inactivates the hardener in the first layer 2 in the regions which are in direct contact therewith. The second layer 3 however does not have an effect on the third layer 7 so that the third layer 7 forms a barrier layer for the sodium hydroxide of the second layer 3. A closed metal layer 4 of chromium covers the second layer 3, parts of the first layer 2 and parts of the third layer 7.

Figure 2B:
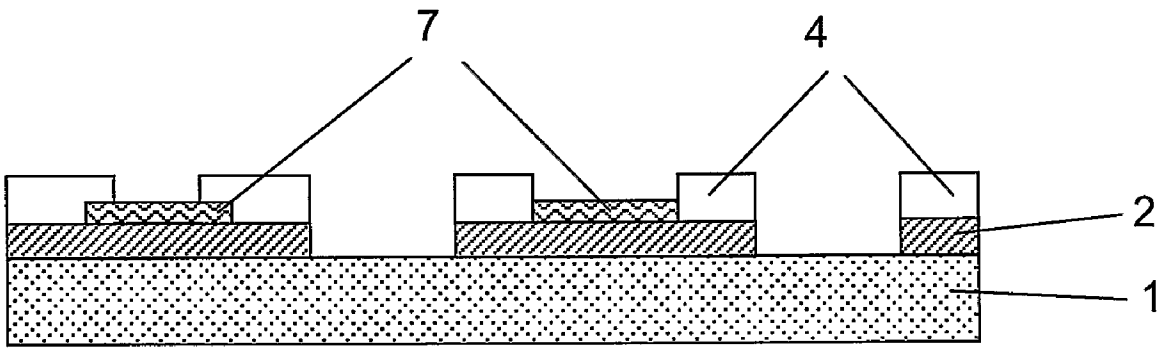
FIG. 2*b* shows the carrier substrate of FIG. 2*a* after dissolution of the second layer and unhardened regions of the first layer.

FIG. 2*b* shows the carrier substrate 1 of FIG. 2*a* after dissolution of the second layer 3 and non-hardened regions of the first layer 2 in water. What remain on the carrier substrate 1 are regions of the first layer 2 in accurate register relationship with regions of the metal layer 4, uncoated regions of the third layer 7 and regions of the third layer 7 which are covered with regions of the metal layer 4. A wide range of different effects can be achieved by varying the arrangement of the individual layers.

Figure 3:
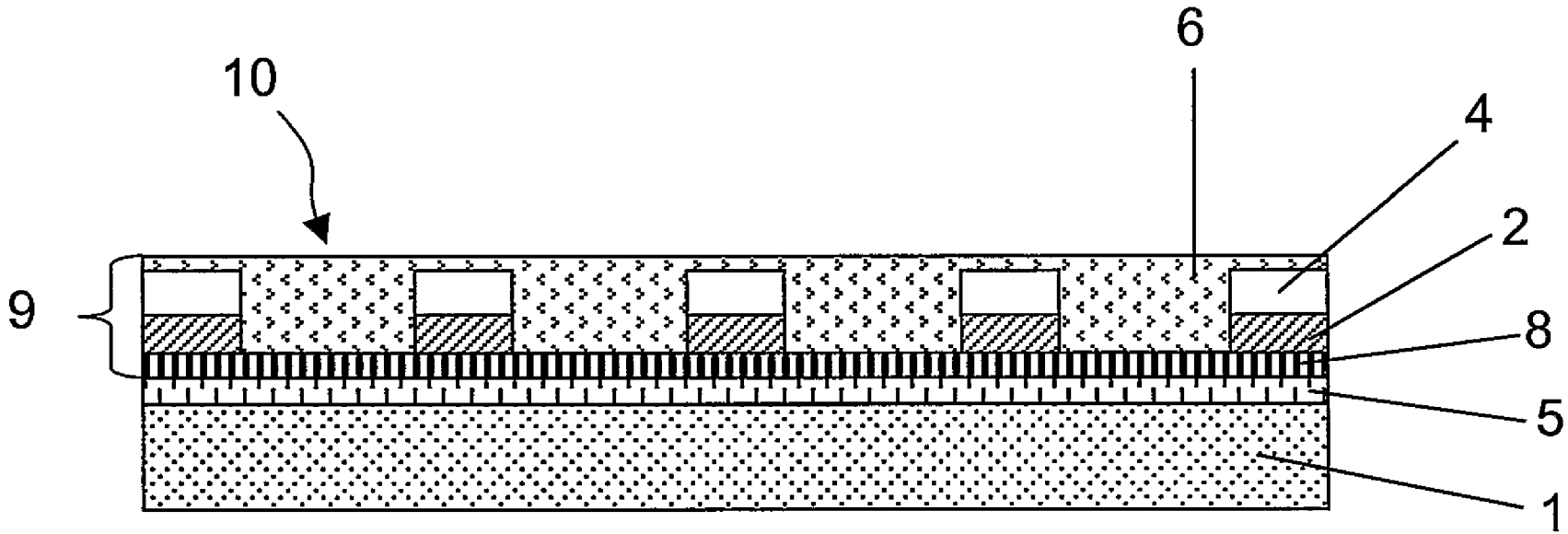

FIG. 3 shows a cross-section through a hot stamping film 10 with region-wise metallization. Disposed on a carrier substrate 1 in the form of a carrier film is a wax-like separation layer 5 which facilitates detachment of a transfer layer arrangement 9 from the carrier substrate 1 onto a material to be stamped upon. Arranged on the separation layer 5 is a colorlessly transparent, insoluble lacquer layer 8 on which regions of the first layer 2 and the metal layer 4 as formed in FIG. 1*b* are arranged. An adhesive layer 6 is disposed on the side of the transfer layer arrangement 9 which is remote from the carrier substrate 1. The adhesive used is preferably a hot-sealable adhesive. In the hot stamping operation the hot stamping film 10 is pressed under the effect of temperature with the adhesive layer 6 against the material to be stamped upon and the transfer layer arrangement 9 is transferred entirely or in region-wise manner, for example in the form of patterns, alphanumeric characters or images. The carrier substrate 1 is separated from the regions of the transfer layer arrangement 9, which have been transferred onto the material to which the hot stamping film has been applied. The colorlessly transparent lacquer layer 8 now forms the surface of the transferred regions of the transfer layer arrangement 9 and protects the layer portions arranged therebeneath, for example from damage or manipulative alteration.

The layer systems illustrated in the Figures can be supplemented by further transparent or opaque layers, in which respect various effects can be produced. Multiple application of the process according to the invention in succession to a carrier film, wherein barrier layers can be deliberately used to prevent an additive becoming effective in given regions or layer planes, is also possible. Furthermore the first layer 2 can be formed from two or more colored, transparent, soluble lacquer layers. It is also possible to use opaque colored layers for structuring or a metal layer which is formed in region-wise manner from metals of differing color. That affords innumerable possible variations which the man skilled in the art will recognize as being embraced by the concept of the invention.

What is claimed is:

1. A process for the production of a region-wise metallization on a carrier substrate, wherein the carrier substrate is at least region-wise provided with a colored first layer which on its side remote from the carrier substrate is provided over its full area with a metal layer, the process comprising:

at least partially arranging at least one water-soluble second layer between the first layer and the metal layer, wherein a hardener is added to the first layer and an additive is added to the second layer, which additive is suitable for inactivating the hardener of the first layer, the additive of the second layer inactivates the hardener of the first layer in the regions of the first layer which are arranged in direct contact with the second layer before the first layer is hardened by the hardener, and the second layer and the regions of the first layer in which the hardener was inactivated are dissolved and removed by means of at least one liquid, wherein the metal layer is removed in the regions which were arranged directly on the second layer.

2. A process as set forth in claim 1, wherein the first layer is formed by an alkali-soluble lacquer.

3. A process as set forth in claim 2, wherein a water-soluble dyestuff is added to the alkali-soluble lacquer.

4. A process as set forth in claim 1, wherein the hardener is selected on an aziridin basis or polyimine basis and that the second layer is formed from a water-soluble alkaline printing ink with a pH-value in the range of between 11 and 14.

5. A process as set forth in claim 4, wherein the printing ink is of an alkaline nature by means of sodium hydroxide or potassium hydroxide as additive.

6. A process as set forth in claim 4, wherein the printing ink is mixed with a coloring filler or pigment.

7. A process as set forth in claim 6, wherein barium sulfate, titanium oxide or zinc sulfide is added to the printing ink.

8. A process as set forth in claim 1, wherein at least one water-insoluble third layer is arranged on the side of the first layer which is towards the metal layer, wherein the at least one third layer is of a colored opaque and/or colored transparent nature.

9. A process as set forth in claim 1, wherein the at least one liquid contains water or consists of water.

10. A process as set forth in claim 1, wherein a flexible film material is used as the carrier substrate.

11. A process as set forth in claim 10, wherein the carrier substrate is transported from roll to roll to produce the region-wise metallization.

12. A process as set forth in claim 1, wherein the metal layer is of a reflecting nature.

13. A process as set forth in claim 1, wherein the metal layer is formed from at least two of the metals aluminum, chromium, copper, nickel, iron, titanium, silver, gold.

14. A process as set forth in claim 1, wherein the metal layer is formed by vapor deposition or cathode sputtering.

15. A process as set forth in claim 1, further comprising:

at least partially arranging at least one water-insoluble third layer region-wise on the side of the first layer which is towards the metal layer and applying the water-soluble second layer at least partially to the side of the third layer which is towards the metal layer and partially to the regions of the first layer which are free of the third layer, wherein the at least one third layer is impenetrable to the additive.

16. A process for the production of a region-wise metallization on a carrier substrate, wherein the carrier substrate is at least region-wise provided with a colored first layer which on its side remote from the carrier substrate is provided over its full area with a metal layer, the process comprising:

at least partially arranging at least one water-insoluble third layer region-wise on the side of the first layer which is towards the metal layer and applying a water-soluble second layer at least partially to the side of the third layer which is towards the metal layer and partially to the regions of the first layer which are free of the third layer, wherein a hardener is added to the first layer and an additive is added to the second layer, which additive is suitable for inactivating the hardener of the first layer, wherein the at least one third layer is impenetrable to the additive, the additive of the second layer inactivates the hardener of the first layer in the regions of the first layer which are arranged in direct contact with the second layer before the first layer is hardened by the hardener, and the second layer and the regions of the first layer in which the hardener was inactivated are dissolved and removed by means of at least one liquid, wherein the metal layer is removed in the regions which were arranged directly on the second layer.

17. A process as set forth in claim 16, wherein the first layer is formed by an alkali-soluble lacquer.

18. A process as set forth in claim 17, wherein a water-soluble dyestuff is added to the alkali-soluble lacquer.

19. A process as set forth in claim 17, wherein the hardener is selected on an aziridin basis or polyimine basis and that the second layer is formed from a water-soluble alkaline printing ink with a pH-value in the range of between 11 and 14.

20. A process as set forth in claim 19, wherein the printing ink is of an alkaline nature formed by sodium hydroxide or potassium hydroxide as an additive.

21. A process as set forth in claim 19, wherein the printing ink is mixed with a coloring filler or pigment.

22. A process as set forth in claim 21, wherein barium sulfate, titanium oxide or zinc sulfide is added to the printing ink.

23. A process as set forth in claim 16, wherein the at least one third layer is of a colored opaque and/or colored transparent nature.

24. A process as set forth in claim 16, wherein the at least one liquid contains water or consists of water.

25. A process as set forth in claim 16, wherein a flexible film material is used as the carrier substrate.

26. A process as set forth in claim 16, wherein the carrier substrate is transported from roll to roll to produce the region-wise metallization.

27. A process as set forth in claim 16, wherein the metal layer is of a reflecting nature.

28. A process as set forth in claim 16, wherein the metal layer is formed from one of the metals aluminum, chromium, copper, nickel, iron, titanium, silver, gold.

29. A process as set forth in claim 16, wherein the metal layer is formed by vapor deposition or cathode sputtering.

30. A process as set forth in claim 16, further comprising:

at least partially arranging the at least one water-soluble second layer between the first layer and the metal layer.

* * * * *